US010589555B2

(12) United States Patent
Matsunai

(10) Patent No.: US 10,589,555 B2
(45) Date of Patent: Mar. 17, 2020

(54) PRINTER AND METHOD FOR AUTOMATICALLY ELIMINATING SLACKNESS OF PRINTING MEDIUM

(71) Applicant: TOSHIBA TEC KABUSHIKI KAISHA, Shinagawa-ku, Tokyo (JP)

(72) Inventor: Tomohiro Matsunai, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 156 days.

(21) Appl. No.: 15/711,056

(22) Filed: Sep. 21, 2017

(65) Prior Publication Data

US 2018/0370265 A1 Dec. 27, 2018

(30) Foreign Application Priority Data

Jun. 22, 2017 (JP) ..... 2017-122431

(51) Int. Cl.
*B41J 33/44* (2006.01)
*B41J 35/02* (2006.01)
(Continued)

(52) U.S. Cl.
CPC ..... *B41J 33/44* (2013.01); *B41J 35/02* (2013.01); *B41J 35/04* (2013.01); *B41J 33/02* (2013.01); *B41J 2202/31* (2013.01)

(58) Field of Classification Search
CPC ... B41J 33/44; B41J 35/02; B41J 35/04; B41J 33/02; B41J 2202/31
See application file for complete search history.

(56) References Cited

U.S. PATENT DOCUMENTS 5,714,996 A * 2/1998 Hodai ..... B41J 17/32 347/214
9,457,925 B1 10/2016 Harashina
(Continued)

FOREIGN PATENT DOCUMENTS

| | | |
|---|---|---|
| EP | 3075550 | 10/2016 |
| JP | 2004-167890 | 6/2004 |
| JP | 2007-118282 | 5/2007 |

OTHER PUBLICATIONS

Extended European Search Report for European Patent Application No. 18178351.5 dated Nov. 19, 2018.

*Primary Examiner* — David H Banh
(74) *Attorney, Agent, or Firm* — Amin, Turocy & Watson, LLP

(57) ABSTRACT

In accordance with an embodiment, a ribbon holding shaft winds an ink ribbon before printing. A ribbon winding shaft winds the ink ribbon after printing to collect the ink ribbon. A feed motor rotationally drives the ribbon holding shaft. A winding motor rotationally drives the ribbon winding shaft. A detection module detects slackness of the ink ribbon stretched between the ribbon holding shaft and the ribbon winding shaft. A ribbon feed control module forward rotates the winding motor to draw out the ink ribbon from the ribbon holding shaft to the printing section and further controls the ribbon winding shaft to wind the ink ribbon. A reverse rotation control module reversely rotates the feed motor to stretch the ink ribbon between the ribbon holding shaft and the ribbon winding shaft if the detection module detects the slackness of the ink ribbon.

15 Claims, 5 Drawing Sheets

(51) Int. Cl.
*B41J 35/04* (2006.01)
*B41J 33/02* (2006.01)

(56) References Cited

U.S. PATENT DOCUMENTS

| | | | | |
|---|---|---|---|---|
| 2004/0146331 | A1* | 7/2004 | McNestry | B41J 2/325<br>400/615.2 |
| 2005/0079298 | A1* | 4/2005 | Keeton | B41J 35/36<br>428/32.6 |
| 2008/0219743 | A1* | 9/2008 | McNestry | B41J 33/34<br>400/234 |
| 2008/0240830 | A1* | 10/2008 | McNestry | B41J 33/34<br>400/234 |
| 2009/0115832 | A1* | 5/2009 | Aihara | B41J 33/16<br>347/217 |
| 2009/0116891 | A1* | 5/2009 | Aihara | B41J 13/12<br>400/244 |
| 2014/0292989 | A1 | 10/2014 | Matsuda | |
| 2016/0288528 | A1 | 10/2016 | Matsuda | |
| 2017/0136780 | A1 | 5/2017 | Hattori et al. | |

* cited by examiner

PRINTER AND METHOD FOR AUTOMATICALLY ELIMINATING SLACKNESS OF PRINTING MEDIUM

CROSS-REFERENCE TO RELATED APPLICATION

This application is based upon and claims the benefit of priority from Japanese Patent Application No. P2017-122431, filed Jun. 22, 2017, the entire contents of which are incorporated herein by reference.

FIELD

Embodiments described herein relate generally to a printer and a method for automatically eliminating slackness of a printing medium.

BACKGROUND

Conventionally, in a printer such as a label printer, a thermal transfer type printer which melts an ink coated on an ink ribbon through a thermal head with heat to transfer the ink is widely used. If the ink ribbon is slack in such a printer, the printing quality deteriorates. However, due to the inertia of sending of lots of the ink ribbon a driving motor at the end time of a printing operation, slackness is likely to occur in the ink ribbon.

As a prior art, a technology relating to the thermal printer is disclosed in which by inputting a trigger signal, tension is applied to the ink ribbon by back feeding an ink ribbon supply shaft, and the slackness of the ink ribbon is thereby eliminated. On the contrary, a technology is desired in which the slackness of the ink ribbon can be eliminated automatically without inputting the trigger.

DETAILED DESCRIPTION

In accordance with an embodiment, a printer comprises a printing section, a ribbon holding shaft, a ribbon winding shaft, a feed motor, a winding motor, a detection module, a ribbon feed control module and a reverse rotation control module. The printing section, arranged to face a print head and a platen, carries out printing on a printing medium conveyed between the print head and the platen with the print head. The ribbon holding shaft winds an ink ribbon before printing. The ribbon winding shaft winds the ink ribbon after printing to collect the ink ribbon. The feed motor rotationally drives the ribbon holding shaft. The winding motor rotationally drives the ribbon winding shaft. The detection module detects slackness of the ink ribbon stretched between the ribbon holding shaft and the ribbon winding shaft. The ribbon feed control module forward rotates the winding motor to draw out the ink ribbon from the ribbon holding shaft to the printing section and further controls the ribbon winding shaft to wind the ink ribbon. The reverse rotation control module reversely rotates the feed motor to stretch the ink ribbon between the ribbon holding shaft and the ribbon winding shaft if the detection module detects the slackness of the ink ribbon.

Hereinafter, a printer and a method for automatically eliminating slackness of printing medium according to the present embodiment is described with reference to the accompanying drawings. The present invention is not limited by the embodiment described below.

Figure 1:
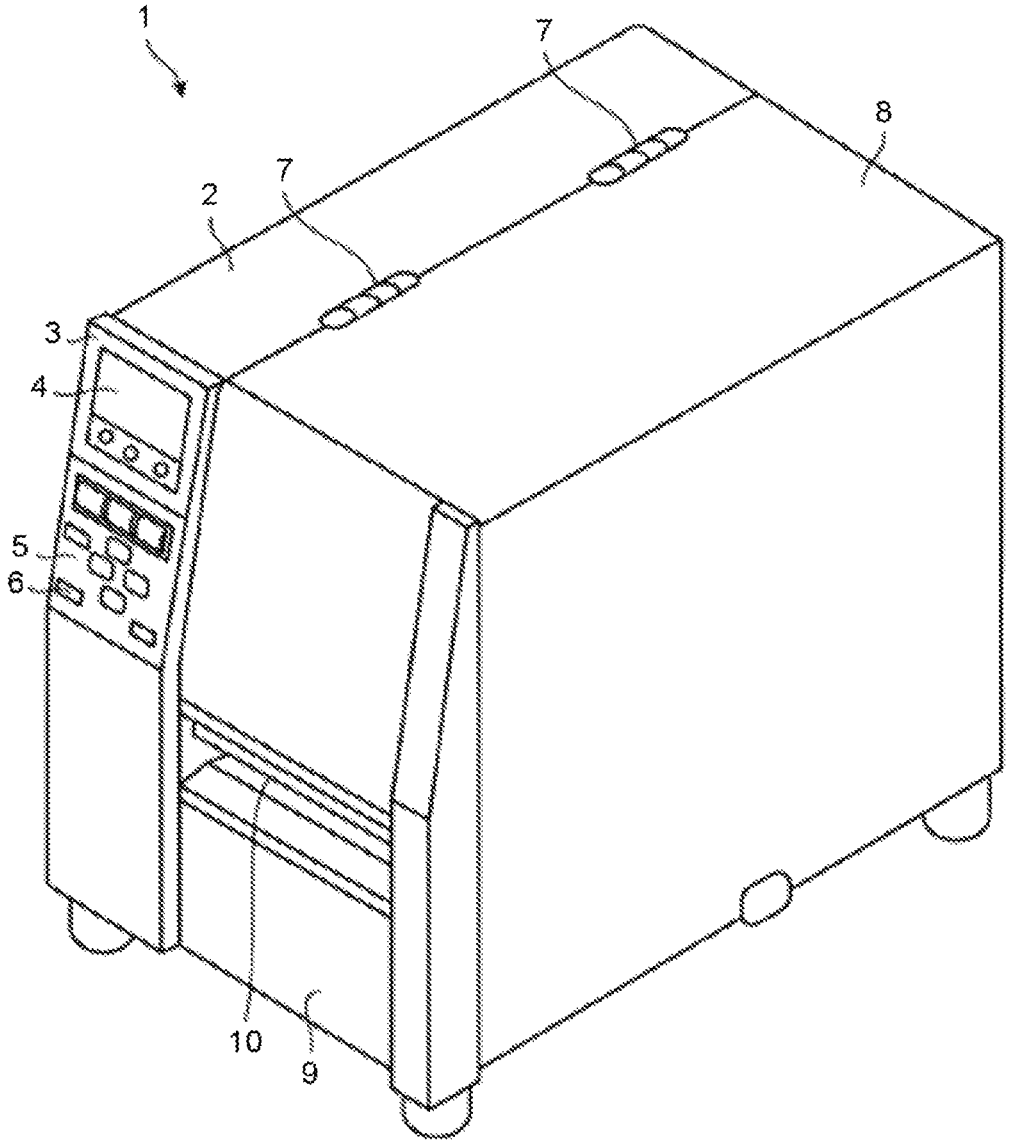
FIG. 1 is an external perspective view of a printer according to an embodiment.

FIG. 1 is an external perspective view of a printer 1 according to the present embodiment. As shown in FIG. 1, the printer 1 includes a casing 2 at the left side and a casing 8 connected to the right side of the casing 2 with a hinge 7. A front panel 3 of the casing 2 includes a display section 4 and an operation section 5. The display section 4 is constituted by a liquid crystal display attached with a backlight; however, it may be constituted by other types of display devices. The operation section 5 is provided with a plurality of operation buttons 6.

The casing 8 at the right side has a structure capable of largely opening the inside of a housing (that is, the casings 2 and 8) by rotating the hinge 7. As described later with reference to FIG. 2, the printer 1 has a label paper 20 wound in a roll shape, an ink ribbon 30 bridged over two shafts, and a printing section 23 printing on the ink ribbon inside the housing thereof. Therefore, by swinging the hinge 7 to raise the casing 8 to the top, it is easy to replace the ink ribbon 30 and the label paper 20 or to facilitate internal maintenance. On the front panel 9 of the casing 8, a label issuing port 10 is provided. The printer 1 issues a label after printing from the label issuing port 10.

Figure 2:
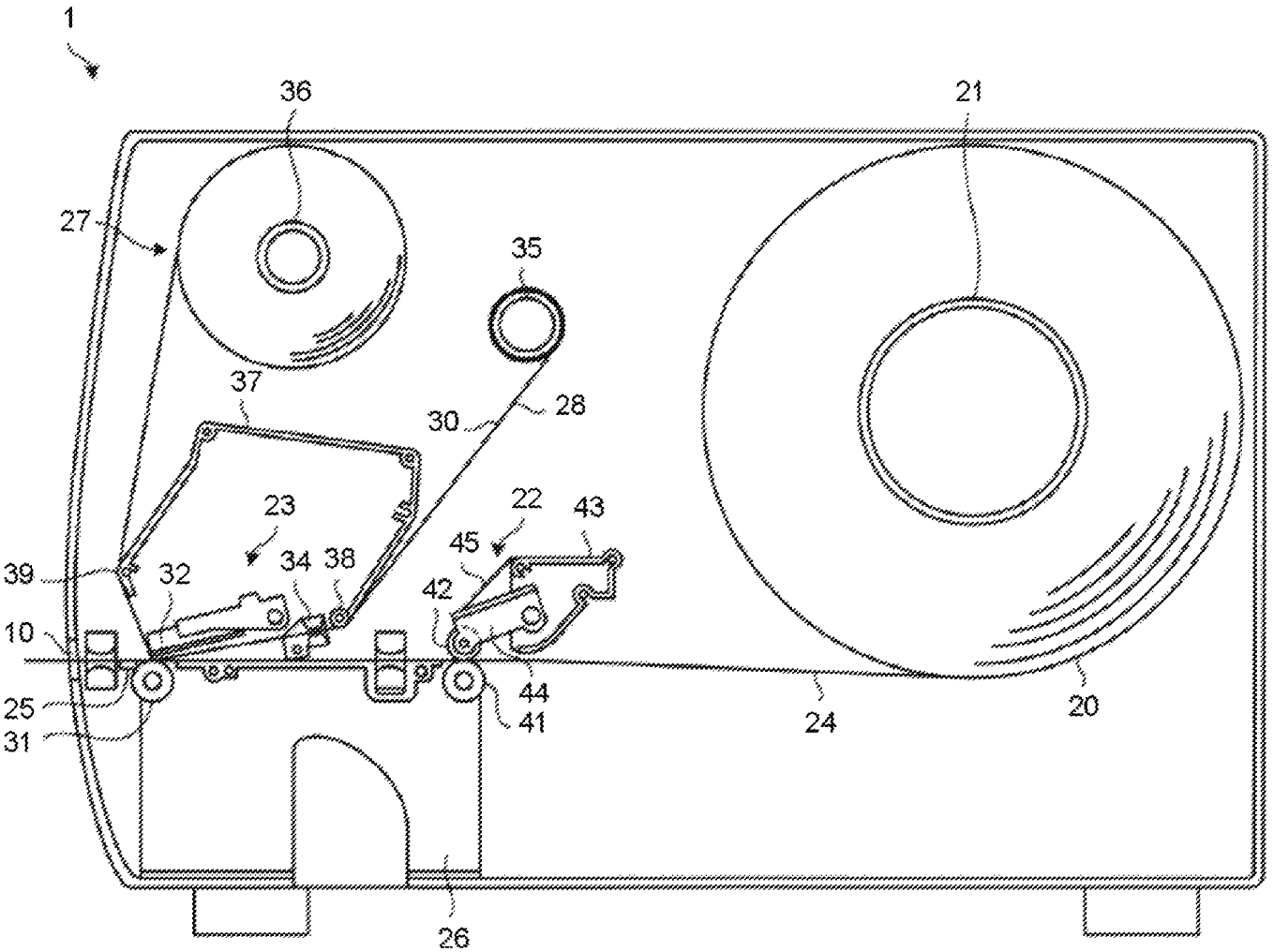
FIG. 2 is a schematically sectional view illustrating the internal constitution of the printer.

FIG. 2 is a schematically sectional view illustrating the internal constitution of the printer 1. As shown in FIG. 2, the printer 1 mainly includes a paper holding section 21, a paper conveyance section 22, a printing section 23, a flame 26 and an ink ribbon supply device 27 inside the housing thereof.

In the paper holding section 21, the label paper 20 is wound in a roll shape and held. The label paper 20 is drawn from the paper holding section 21 and discharged from the label issuing port 10 after the label paper passes through the paper conveyance section 22 and is then printed by the printing section 23. As an example of the label paper 20, a label paper obtained by pasting a label on a mount can be used.

The paper conveyance section 22 mainly includes a paper conveyance roller 41, a pinch roller 42, a flame 43, a support section 44 and a leaf spring 45. The pinch roller 42 is rotatably supported by the support section 44. The paper conveyance roller 41 and the pinch roller 42 abut against each other via the label paper 20 conveyed on a conveyance path 24. The paper conveyance roller 41 is rotatably attached to the flame 26 and is rotated by being driven by a driving structure (not shown).

The support section 44 is swingably attached to the flame 43. One end of the leaf spring 45 is attached to the flame 43, and the other end of the leaf spring 45 abuts against the pinch roller 42. However, the pinch roller 42 is energized by the leaf spring 45 to abut against the paper conveyance roller 41.

The conveyance path 24 of the label paper 20 begins where the label paper 20 is drawn from the paper holding section 21. The conveyance path 24 passes through a position where the pinch roller 42 and the paper conveyance roller 41 abut against each other in the paper conveyance section 22. Further, the conveyance path 24 is ended with the label issuing port 10 through the position where the print head 32 and the platen 31 of the printing section 23 abut against each other.

In the conveyance path 24, a label peeling plate 25 is provided at the downstream side in a conveyance direction with respect to the printing section 23. The label peeling plate 25 bends the label paper 20 being conveyed to separate the label and the mount. The peeled mount is wound around a winding shaft (not shown), while the label peeled from the mount is issued from the label issuing port 10.

The printing section 23 mainly includes the platen 31 and the print head 32 which is a line type thermal printer head. The constitution of the print head 32 corresponds to a printing method. For example, in the case of the printer of an impact dot type, the print head 32 of the impact dot type is used. The platen 31 is rotatably attached to the flame 26 and driven to rotate by a driving section (not shown).

The print head 32 is fixed to a head holding section 33 rotatably attached to a flame (not shown).

The ink ribbon supply device 27 mainly includes a ribbon holding shaft 35, a ribbon winding shaft 36, a ribbon end sensor 34, and a guide flame 37. The ribbon holding shaft 35 winds the unused ink ribbon 30 in a roll shape. At the end of the guide flame 37 at the side of the ribbon holding shaft 35, a guide roller 38 which guides the ink ribbon 30 drawn out from the ribbon holding shaft 35 is provided. The guide roller 38 is provided rotatably with respect to the guide flame 37.

After abutting against the guide roller 38, the ink ribbon 30 before printing reaches a position where the print head 32 and the platen 31 abut against each other via a detection target area of the ribbon end sensor 34, and then transfer is made thereon by the print head 32. After printing, the ink ribbon 30 abuts against the end 39 at the ribbon winding shaft 36 side of the guide flame 37 and is then wound by the ribbon winding shaft 36 to be collected.

The conveyance path 28 of the ink ribbon 30 begins where the ink ribbon 30 is drawn out from the ribbon holding shaft 35 and passes through a position abutting against the guide roller 38 of the guide flame 37. Then, the conveyance path 28 sequentially passes through the detection target area of the ribbon end sensor 34 and a position where the print head 32 and the platen 31 abut against each other (e.g., a printing position). Furthermore, the conveyance path 28 is ended with a portion where the label is wound by the ribbon winding shaft 36 via a position abutting against an end part 39 of the guide flame 37.

The ribbon end sensor 34 is used for detecting the ribbon end, e.g., an end of the ink ribbon 30. As shown in FIG. 2, the ribbon end sensor 34 is arranged in the conveyance path 28 between the printing section 23 and the ribbon holding shaft 35. The ribbon end sensor 34 is preferably provided along the conveyance path 28 of the ink ribbon 30 as shown in FIG. 2 and may be provided between the printing section 23 and the guide roller 38 in the conveyance path 28. More preferably, the ribbon end sensor 34 may be positioned between the position where the print head 32 and the platen 31 abut against each other in the printing section 23 (i.e., a printing position or a transfer position) and the guide roller 38.

If the guide flame 37 is not arranged with the guide roller 38, a preferred installation position of the ribbon end sensor 34 is a position between the position where the print head 32 and the platen 31 abut against each other and the end of the guide flame 37 at the ribbon holding shaft 35 side.

As the ribbon end sensor 34, an optical sensor that optically detects the ink ribbon 30 can be used. As a preferable example, as the ribbon end sensor 34, the reflected light sensor having a light emitting element and a light receiving element may be used. As the ribbon end sensor 34, a sensor for mechanically detecting the ink ribbon 30 may be used.

Figure 3:
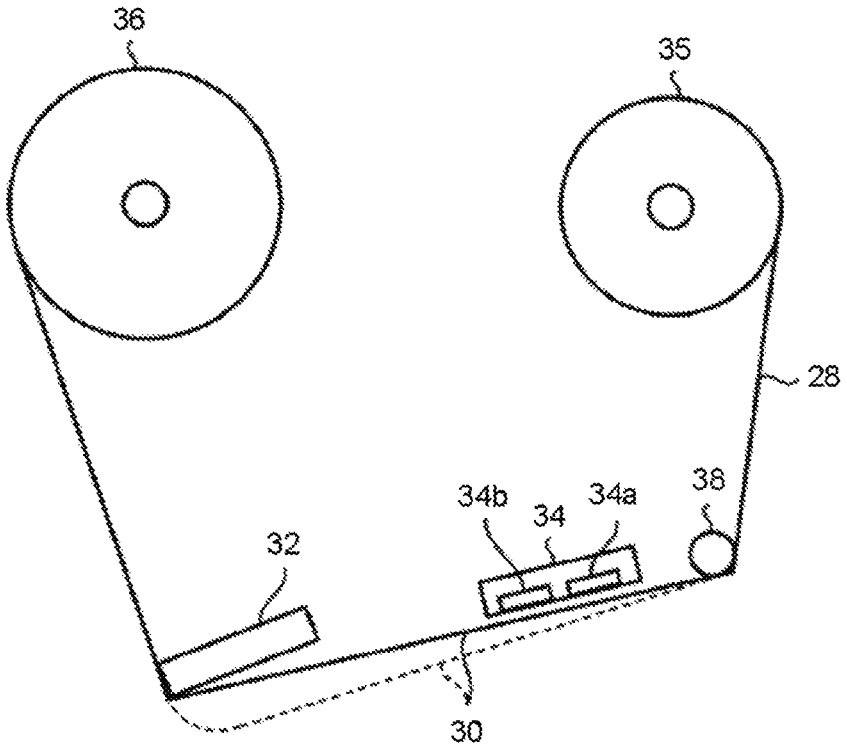
FIG. 3 is a schematic view exemplifying the constitution in a case of using a reflected light sensor as a ribbon end sensor.

FIG. 3 is a schematic view exemplifying the constitution in a case of using a reflected light sensor as the ribbon end sensor 34. In the schematic view in FIG. 3, for convenience, the constitution shown in FIG. 2 is described with a part thereof omitted (for example, an end 39 is omitted). As shown in FIG. 3, the reflected light detection type ribbon end sensor 34 has a light emitting element 34*a* and a light emitting element 34*b* at the same side along the conveyance path 28 of the ink ribbon 30. The light emitting element 34*a* irradiates the ink ribbon 30, and the light emitting element 34*b* detects reflected light from the ink ribbon 30. The printer 1 executes a threshold value determination on the amount of received light (received light intensity or received light level) of the light emitting element 34*b* to be capable of determining the presence or absence of the ink ribbon 30, detecting the ribbon end, or detecting a difference in surface state. The printer 1 can detect the slackness of the ribbon end sensor 34 by executing the threshold value determination on the amount of received light of the light emitting element 34*b*.

Detection Method of Ribbon End

Although the detection method of the ribbon end is not particularly limited, as an example, a silver end mark having a high reflectance may be provided at the front side of the ribbon end to detect that the ribbon end is near by the increase in the amount of received light. As another detection method, the ribbon end may be detected at the time the ribbon disappears and there is no reflected light and the amount of received light falls to near zero. In any case, the threshold value of the amount of received light for determining the ribbon end may be set in advance, and the ribbon end may be detected by the threshold value determination.

Detection Method of Slackness of Ink Ribbon

In the present embodiment, the ribbon end sensor 34 is also used as a sensor for detecting the slackness of the ink ribbon 30. Since the ink ribbon 30 is easy to loosen outside the conveyance path 28, in a case of using the reflected light sensor as the ribbon end sensor 34 as described above, the distance between the ribbon end sensor 34 and the ink ribbon 30 becomes large due to the slackness, and that slackness occurs in the ink ribbon 30 can be determined if the amount of received light decreases. If the ink ribbon 30 slackens, the angle at which the surface of the ink ribbon 30 faces the reflected light sensor changes, and the ink ribbon 30 and the reflected light sensor do not directly face each other, so that it is considered that the amount of received light decreases also due to this phenomenon. Since the change in the amount of received light due to the slackness is small compared to the change in the amount of received light at the ribbon end, detection levels of a threshold value for detecting ribbon end and a threshold value for detecting the slackness are separated from each other, and the threshold values are not close. If both of the threshold values are preset based on experimental results and the like, the printer 1 can easily distinguish and detect the slackness of the ribbon end and the ink ribbon 30.

In the present embodiment, as described above, since the ribbon end sensor 34 for detecting the ribbon end is also used for detecting the slackness of the ink ribbon 30, it is possible to eliminate the slackness of the ink ribbon 30 without largely changing the conventional apparatus structure.

As the ribbon end sensor 34, other optical sensors, for example, a transmitted light sensor may be used. In this case, as stated above, the threshold value for detecting the ribbon end and the threshold value for detecting the slackness of the ink ribbon 30 are respectively set, and the threshold value determination is made respectively on them. In the above description, the ribbon end sensor 34 is also used for detecting the slackness of the ink ribbon 30, but a sensor for detecting the slackness may be provided separately from the ribbon end sensor 34.

The hardware structure of the printer 1 is described below.

Figure 4:
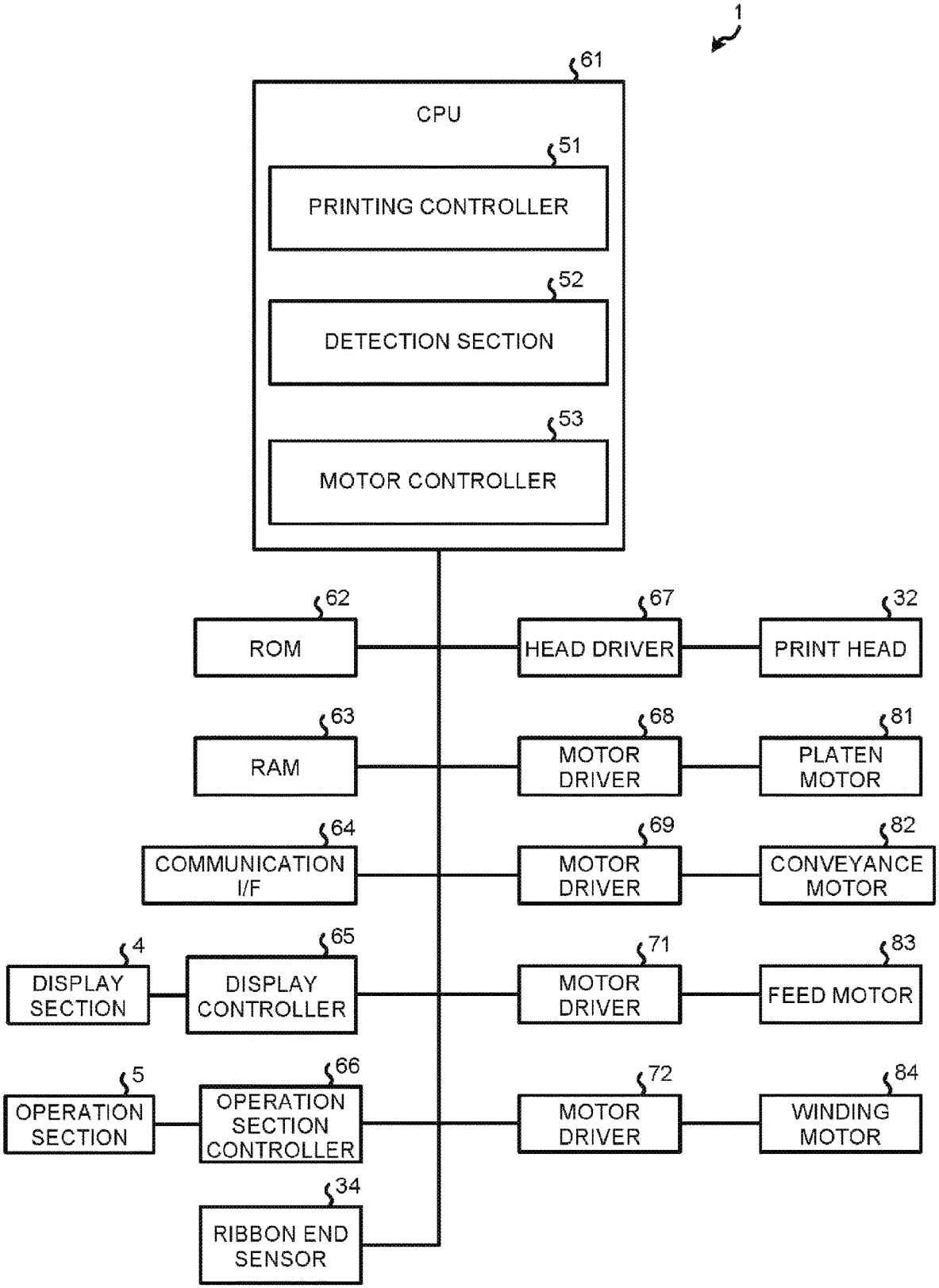
FIG. 4 is a block diagram illustrating the hardware structure of the printer.

FIG. 4 is a block diagram illustrating the hardware structure of the printer 1. As shown in FIG. 4, the printer 1 includes a CPU 61, a ROM 62, and a RAM 63. The CPU 61 is connected to a communication I/F (interface) 64, a display controller 65, an operation section controller 66, a head driver 67, motor drivers 68, 69, 71, and 72, the ribbon end sensor 34 via a bus line and an interface.

The display section 4 (refer to FIG. 1) is connected to the display controller 65. The operation section 5 (refer to FIG. 1) is connected to the operation section controller 66. The print head 32 (refer to FIG. 2) is connected to the head driver 67. In the print head 32, heating elements are linearly provided in a direction orthogonal to the conveyance direction of the label paper 20. The head driver 67 thermally transfers a print image on the label paper 20 by switching ON/OFF of energization to a heat generation element of the print head 32 based on the print data.

The motor driver 68 is connected to a platen motor 81 which rotationally drives the platen 31 (refer to FIG. 2) of the printing section 23. The motor driver 69 is connected to a conveyance motor 82 for rotationally driving the paper conveyance roller 41 (refer to FIG. 2) of the paper conveyance section 22. The motor driver 71 is connected to a feed motor 83 for rotationally driving the ribbon holding shaft 35 (refer to FIG. 2). The motor driver 72 is connected to a winding motor 84 rotationally driving the ribbon winding shaft 36 (refer to FIG. 2). The constitution of each motor is not limited, and for example, a stepping motor can be used.

The ROM 62 stores programs executed by the printer 1 and various data. The RAM 63 is a development memory for temporarily storing programs and data if the CPU 61 executes the above-mentioned various programs. The communication I/F 64 connects the printer 1 to a host computer (not shown), and controls data communication between the printer 1 and the host computer. The host computer transmits the print data (or print command) to the RAM 63 via the communication I/F 64. The print data may be input via the operation section 5.

A program executed by the printer 1 of the present embodiment is described below.

The programs executed by the printer 1 of the present embodiment may be incorporated into the ROM 62 or the like to be provided. The programs maybe recorded in a computer-readable recording medium such as a CD-ROM, a FD (Flexible Disk), a CD-R, a DVD (Digital Versatile Disk) and the like in the form of installable or executable file to be provided.

Further, the programs executed by the printer 1 of the present embodiment may be stored in a computer connected with a network such as Internet and downloaded via the network to be supplied. The programs executed by the printer 1 of the present embodiment may be supplied or distributed via the network such as the Internet.

As shown in FIG. 4, the programs executed in the printer 1 of the present embodiment has a module constitution including a printing controller 51, a detection section 52, and a motor controller 53. The CPU 61 (processor) reads the program from the storage medium such as the ROM 62 and loads the respective sections on the main storage device (for example, the RAM 63). As a result, the printing controller 51, the detection section 52, and the motor controller 53 are generated on the main storage device. Next, the function of each section is described.

If the print data is input via the communication I/F 64 or the operation section controller 66, the printing controller 51 controls the operation of the print head 32 via the head driver 67 to transfer the print data on the label paper 20.

The detection section 52 controls the detection operation of the ribbon end sensor 34. The detection section 52 detects the ribbon end based on the amount of received light detected by the ribbon end sensor 34 and a predetermined threshold value for ribbon end detection. As an example, in a case in which the ink ribbon provided with the end mark with a high reflectance as described above is used, if the amount of received light exceeds the threshold value for ribbon end detection, the detection section 52 determines that the ribbon end is detected.

The detection section 52 detects the slackness of the ink ribbon 30 based on the amount (intensity of the received light) of the received light of the ribbon end sensor 34 and the predetermined threshold value for detecting the slackness. As an example, the detection section 52 determines that the slackness occurs in the ink ribbon 30 if the amount of received light falls below the threshold value for detecting the slackness.

At any timing until the start of the next printing operation after the stop of the printing operation, the detection section 52 (determination module) may determine whether or not the amount of received light of the ribbon end sensor 34 is equal to or less than the threshold value. The timing at which the printing operation is stopped may be any timing such as temporary stop, interruption (forced termination, etc.) or the like during the printing operation in addition to timing at the completion of the printing operation for one label. It is considered that the slackness of the ink ribbon 30 is caused by the inertia of the motor rotation if the motor drive is stopped. Therefore, by determining the slackness of the ink ribbon 30 at the timing at which the printing operation is stopped, the slackness can be detected promptly.

The motor controller 53 controls the rotational driving of the platen motor 81 via the motor driver 68. The motor controller 53 controls the rotational driving of the conveyance motor 82 via the motor driver 69. The motor controller 53 controls the rotation driving of the feed motor 83 via the motor driver 71. The motor controller 53 controls the rotational driving of the winding motor 84 via the motor driver 72.

For example, at the time of the ribbon feed control, the motor controller 53 (ribbon feed control module) forward rotates the winding motor 84 to draw out the ink ribbon 30 from the ribbon holding shaft 35 to send it to the printing section 23 and winds the ink ribbon 30 with the ribbon winding shaft 36. During the ribbon feed control, the motor controller 53 applies a tension to the feed motor 83 in an opposite rotational direction to the winding motor 84 to keep the ink ribbon 30 in a stretched state between the ribbon holding shaft 35 and the ribbon winding shaft 36.

If the detection section 52 detects the slackness of the ink ribbon 30, the motor controller 53 (reverse rotation control module) reversely rotates the feed motor 83 to stretch the ink ribbon 30 between the ribbon holding shaft 35 and the ribbon winding shaft 36. For example, the motor controller 53 stops driving the winding motor 84 if the ribbon feed control is stopped. Then, if the detection section 52 detects the slackness of the ink ribbon 30, the motor controller 53 reversely rotates the feed motor 83 while stopping the winding motor 84 to stretch the ink ribbon 30 to release the slackness.

As described above, in the present embodiment, if it is determined that slackness occurs in the ink ribbon 30, the feed motor 83 is automatically rotated in the reverse direction to increase the tension (tensile stress) of the ink ribbon 30 between the ribbon holding shaft 35 and the ribbon winding shaft 36. Thereby, in the vicinity of the printing position (transfer position), located between the ribbon holding shaft 35 and the ribbon winding shaft 36, at which the print head 32 and the platen 31 are disposed facing each other and thermal transfer is executed, the slackness of the ink ribbon 30 can be automatically eliminated.

Next, a procedure example of a slackness elimination control executed by the printer 1 is described.

Figure 5:
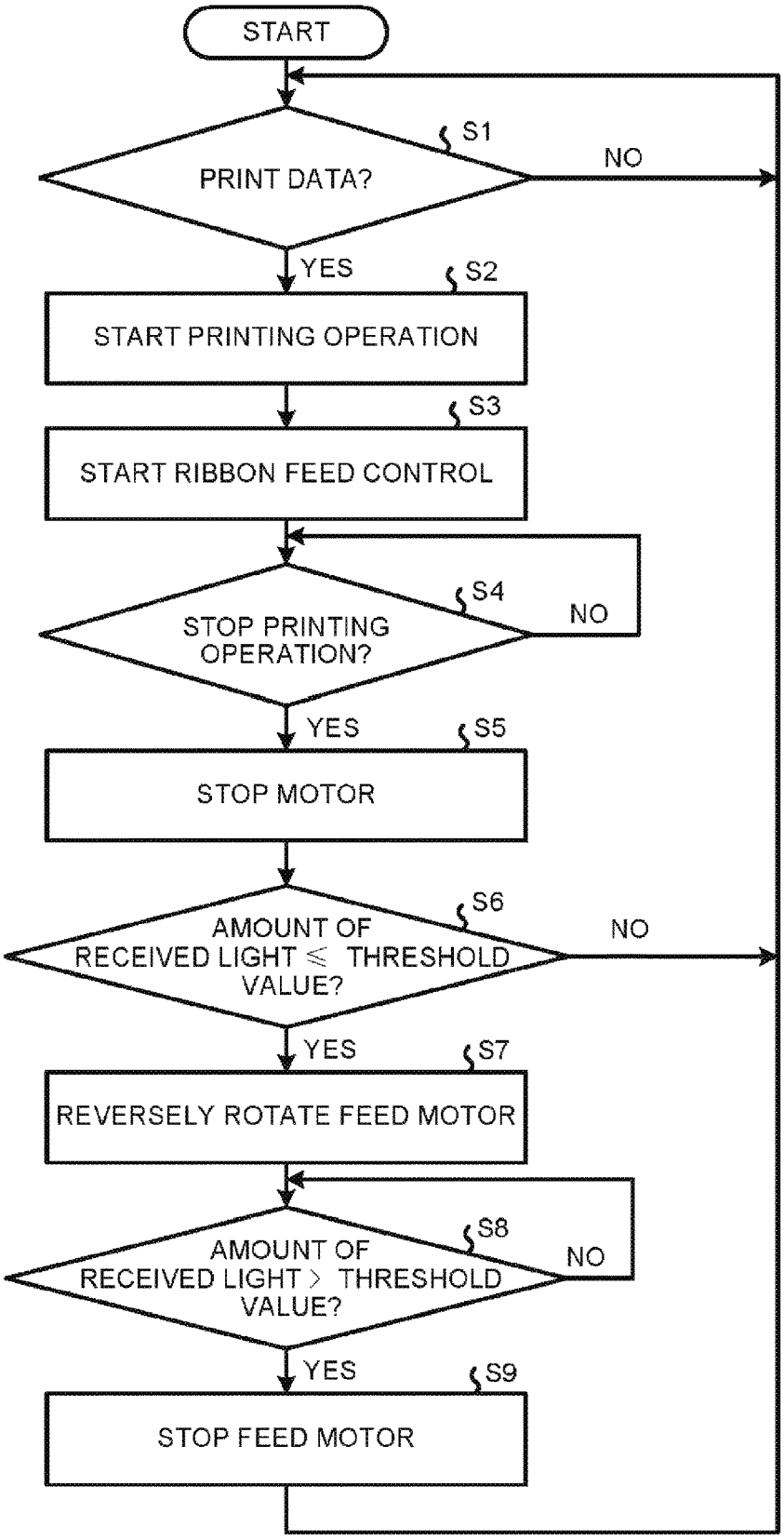
FIG. 5 is a flowchart exemplifying the procedure of a slackness elimination control executed by the printer.

FIG. 5 is a flowchart exemplifying the procedure of the slackness elimination control executed by the printer 1.

If the print data is input from the communication I/F 64 or the operation section 5 (Yes in Act S1), the printing controller 51 outputs the print data to the head driver 67 and starts the printing operation by the print head 32 (Act S2). The motor controller 53 starts the ribbon feed control in which the winding motor 84 is forward rotated to draw out the ink ribbon 30 towards the printing section 23 via the motor drivers 71 and 72 (Act S3). The motor controller 53 controls the platen motor 81 and the conveyance motor 82 to start rotational driving of the platen 31 and the paper conveyance roller 41. The motor controller 53 starts the label feed control. In this way, the label paper 20 is drawn from the paper holding section 21 to be conveyed to the printing section 23 along the conveyance path 24.

While the print data is not input (No in Act S1), the flow returns to Act S1 to wait. If the label paper 20 reaches the position of the print head 32, the printing controller 51 controls the heat generation operation of the print head 32 and starts transferring the print data. If the printed label paper 20 is discharged from the label issuing port 10, the motor controller 53 stops driving each motor, and the printing controller 51 stops energizing the print head 32 to terminate heat generation operation. In a case in which a plurality of labels is instructed to be issued by the print command, if the issuance of the instructed number of labels is completed, the motor drive is stopped and the head drive is stopped.

While the printing operation is not stopped (No in Act S4), the flow returns to Act S4 to continue the above-described printing operation. If the printing operation is stopped (Yes in Act S4), the motor controller 53 stops the feed motor 83 and the winding motor 84 (Act S5). The detection section 52 determines whether or not the amount of received light of the ribbon end sensor 34 is equal to or less than the threshold value for detecting the slackness (Act S6). If the amount of received light is greater than the predetermined threshold value (No in Act S6), the flow proceeds to the processing in Act S1.

If the amount of received light becomes equal to or less than the predetermined threshold value (Yes in Act S6), the motor controller 53 reversely rotates the feed motor 83 (Act S7). The detection section 52 determines whether or not the amount of received light of the ribbon end sensor 34 is greater than the threshold value for detecting the slackness (Act S8). Until the amount of received light exceeds the threshold value (No in Act S8), the motor controller 53 continues the reverse rotation of the feed motor 83. If the amount of received light becomes greater than the threshold value for detecting the slackness (Yes in Act S8), the motor controller 53 stops the feed motor 83 if it is assumed that the slackness of the ink ribbon 30 is eliminated (Act S9). After the processing in Act S9, the flow proceeds to the processing in Act S1 and waits for input of the next print data.

In the above-described Act S6, the detection section 52 determines that the slackness occurs in the ink ribbon 30 if the amount of received light of the ribbon end sensor 34 becomes equal to or less than the predetermined threshold value, but the determination method is not limited thereto. The detection section 52 may determine that the slackness occurs in the ink ribbon 30 if the amount of received light falls below a predetermined threshold value, or it belongs to a predetermined range of value. The threshold value or the range of value serving as a determination criterion may be set appropriately via the operation section 5 or the communication I/F 64.

In the above description, as an example of applying the label printer for printing on the label paper wound in a roll shape as the printer in the present embodiment is described; however, the embodiment is not limited thereto. The printing medium is not limited to the label paper, and a printer printing on other printing media (e.g., a tag paper, a receipt paper etc.) may be used. The printing medium is not limited to a type wound in the roll shape, and may be the printer for sending the sheet-like printing medium to the printing section.

In the above embodiment, an example in which a thermal transfer type printer (thermal printer) using a thermal transfer ribbon as the ink ribbon is used is described, but the above embodiment may be applied to other types of the printer using the ink ribbon. For example, by applying the present embodiment to a typewriter or the printer of the impact dot type, the slackness of the ink ribbon can be automatically eliminated and the quality of printing can be ameliorated.

As described above, according to the printer 1 of the present embodiment, if the slackness of the ink ribbon 30 is detected, the motor controller 53 reversely rotates the feed motor 83 to stretch the ink ribbon 30 between the ribbon holding shaft 35 and the ribbon winding shaft 36. Thus, in the present embodiment, the slackness of the ink ribbon can be automatically eliminated.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer, comprising:

a printing section, arranged to face a print head and a platen, configured to print on a printing medium conveyed between the print head and the platen with the print head;

a ribbon holding shaft configured to wind an ink ribbon before printing; a ribbon winding shaft configured to wind the ink ribbon after printing to collect the ink ribbon;

a feed motor configured to rotationally drive the ribbon holding shaft;

a winding motor configured to rotationally drive the ribbon winding shaft;

a detector configured to detect for slackness of the ink ribbon between the ribbon holding shaft and the ribbon winding shaft;

a ribbon feed controller configured to forward rotate the winding motor to draw out the ink ribbon from the ribbon holding shaft to the printing section and control the ribbon winding shaft to wind the ink ribbon;

a reverse rotation controller configured to reversely rotate the feed motor to stretch the ink ribbon between the ribbon holding shaft and the ribbon winding shaft if the detector detects the slackness of the ink ribbon between the ribbon holding shaft and the ribbon winding shaft; and a determination module configured to determine whether an amount of received light by the detector is equal to or less than a threshold value for detecting the slackness at any timing until a next printing operation is started after a printing operation is stopped.

2. The printer according to claim 1, wherein a guide roller configured to abut against the ink ribbon to guide the ink ribbon to the printing section in a conveyance path of the ink ribbon between the printing section and the ribbon holding shaft, wherein the detector is an optical sensor arranged along the conveyance path of the ink ribbon, and is arranged between the printing section and the guide roller in the conveyance path of the ink ribbon.

3. The printer according to claim 2, wherein the optical sensor comprises a ribbon end sensor for detecting an end of the ink ribbon.

4. The printer according to claim 2, further comprising:

a determination module configured to determine whether an amount of received light by the optical sensor is equal to or less than a threshold value for detecting the slackness at any timing until a next printing operation is started after a printing operation is stopped.

5. The printer according to claim 3, further comprising:

a determination module configured to determine whether an amount of received light by the optical sensor is equal to or less than a threshold value for detecting the slackness at any timing until a next printing operation is started after a printing operation is stopped.

6. The printer according to claim 2, wherein the optical sensor comprises a reflected light sensor for detecting reflected light from the ink ribbon.

7. A method for automatically eliminating slackness of a printing medium, comprising:

printing on a printing medium conveyed between a print head and a platen with the print head through a printing section arranged to face the print head and the platen;

winding an ink ribbon before printing from a ribbon holding shaft;

winding the ink ribbon after printing to collect the ink ribbon with a ribbon winding shaft;

detecting for slackness of the ink ribbon between the ribbon holding shaft and the ribbon winding shaft;

forward rotating a winding motor to draw out the ink ribbon from the ribbon holding shaft to the printing section and controlling the ribbon winding shaft to wind the ink ribbon;

reversely rotating the ribbon holding shaft to stretch the ink ribbon between the ribbon holding shaft and the ribbon winding shaft if slackness of the ink ribbon is detected between the ribbon holding shaft and the ribbon winding shaft; and determining whether an amount of received light is equal to or less than a threshold value for detecting the slackness at any timing until a next printing operation is started after a printing operation is stopped.

8. The method according to claim 7, wherein abutting a guide roller against the ink ribbon to guide the ink ribbon to the printing section in a conveyance path of the ink ribbon between the printing section and the ribbon holding shaft, wherein detecting is carried out with an optical sensor arranged along the conveyance path of the ink ribbon.

9. The method according to claim 8, further comprising:

detecting an end of the ink ribbon.

10. A label printer, comprising:

a printing section, arranged to face a print head and a platen, configured to print on a label paper conveyed between the print head and the platen with the print head;

a ribbon holding shaft configured to wind an ink ribbon before printing;

a ribbon winding shaft configured to wind the ink ribbon after printing to collect the ink ribbon;

a feed motor configured to rotationally drive the ribbon holding shaft;

a winding motor configured to rotationally drive the ribbon winding shaft;

a detector configured to detect for slackness of the ink ribbon between the ribbon holding shaft and the ribbon winding shaft;

a ribbon feed controller configured to forward rotate the winding motor to draw out the ink ribbon from the ribbon holding shaft to the printing section and control the ribbon winding shaft to wind the ink ribbon;

a reverse rotation controller configured to reversely rotate the feed motor to stretch the ink ribbon between the ribbon holding shaft and the ribbon winding shaft if the detector detects the slackness of the ink ribbon between the ribbon holding shaft and the ribbon winding shaft; and a determination module configured to determine whether an amount of received light by the detector is equal to or less than a threshold value for detecting the slackness at any timing until a next printing operation is started after a printing operation is stopped.

11. The label printer according to claim 10, wherein a guide roller configured to abut against the ink ribbon to guide the ink ribbon to the printing section in a conveyance path of the ink ribbon between the printing section and the ribbon holding shaft, wherein the detector is an optical sensor arranged along the conveyance path of the ink ribbon, and is arranged between the printing section and the guide roller in the conveyance path of the ink ribbon.

12. The label printer according to claim 11, wherein the optical sensor comprises a ribbon end sensor for detecting an end of the ink ribbon.

13. The label printer according to claim 11, further comprising:

a determination module configured to determine whether an amount of received light by the optical sensor is equal to or less than a threshold value for detecting the slackness at any timing until a next printing operation is started after a printing operation is stopped.

14. The label printer according to claim 12, further comprising:

a determination module configured to determine whether an amount of received light by the optical sensor is equal to or less than a threshold value for detecting the slackness at any timing until a next printing operation is started after a printing operation is stopped.

15. The label printer according to claim 11, wherein the optical sensor comprises a reflected light sensor for detecting reflected light from the ink ribbon.

* * * * *